US011104503B2

(12) United States Patent
Philip et al.

(10) Patent No.: US 11,104,503 B2
(45) Date of Patent: Aug. 31, 2021

(54) PILL DISPENSER

(71) Applicant: AMCOR RIGID PACKAGING USA, LLC, Wilmington, DE (US)

(72) Inventors: Bradley S. Philip, Tecumseh, MI (US); Mark Woloszyk, Chelsea, MI (US); James Stelzer, South Lyon, MI (US)

(73) Assignee: Amcor Rigid Packaging USA, LLC, Plymouth, MI (US)

( * ) Notice: Subject to any disclaimer, the term of this patent is extended or adjusted under 35 U.S.C. 154(b) by 317 days.

(21) Appl. No.: 16/087,862

(22) PCT Filed: Mar. 25, 2016

(86) PCT No.: PCT/US2016/024152
§ 371 (c)(1),
(2) Date: Sep. 24, 2018

(87) PCT Pub. No.: WO2017/164885
PCT Pub. Date: Sep. 28, 2017

(65) Prior Publication Data

US 2020/0299053 A1 Sep. 24, 2020

(51) Int. Cl.
*A61J 7/02* (2006.01)
*B65D 83/04* (2006.01)

(52) U.S. Cl.
CPC ..... *B65D 83/0427* (2013.01); *A61J 7/02* (2013.01)

(58) Field of Classification Search
CPC ..... A61J 7/0084; A61J 7/0409; B65D 83/04; B65D 83/0409
See application file for complete search history.

(56) References Cited

U.S. PATENT DOCUMENTS 4,653,668 A 3/1987 Gibilisco et al.
2005/0269348 A1 12/2005 Limback et al.
2010/0006589 A1 1/2010 Klein
(Continued)

FOREIGN PATENT DOCUMENTS

DE 102014117985 A1 12/2015
EP 2502852 A1 9/2012
(Continued)

OTHER PUBLICATIONS

International Search Report and Written Opinion issued in PCT/US2016/024152, dated Oct. 21, 2016; ISA/KR.
(Continued)

*Primary Examiner* — Gene O Crawford
*Assistant Examiner* — Ayodeji T Ojofeitimi
(74) *Attorney, Agent, or Firm* — Luke A. Mast

(57) ABSTRACT

A pill dispenser including a first primary ramp and a second primary ramp, which is opposite to the first primary ramp. Also included are a first secondary ramp and a second secondary ramp, which is opposite to the first secondary ramp. The first and second secondary ramps are both between the first and the second primary ramps. The pill dispenser further has an outlet including outlet sidewalls and an aperture through which pills are dispensed from, or loaded into, the pill dispenser. The outlet sidewalls extend to the aperture from the first primary ramp, the second primary ramp, the first secondary ramp, and the second secondary ramp.

42 Claims, 10 Drawing Sheets

(56) References Cited

U.S. PATENT DOCUMENTS

| | | | | |
|---|---|---|---|---|
| 2011/0060457 | A1* | 3/2011 | De Vrught | A61J 1/03 700/241 |
| 2016/0001955 | A1 | 1/2016 | Wang et al. | |
| 2017/0231871 | A1* | 8/2017 | Aldasouqi | A61J 7/0084 221/203 |

FOREIGN PATENT DOCUMENTS

| | | | |
|---|---|---|---|
| GB | 2257421 | A | 1/1993 |
| JP | 2006248566 | A | 9/2006 |
| WO | 2005004787 | A1 | 1/2005 |

OTHER PUBLICATIONS

Supplementary European Search Report issued in corresponding European Application No. 168956886 dated Aug. 9, 2019.

* cited by examiner

PILL DISPENSER

CROSS REFERENCE TO RELATED APPLICATION

This application is a U.S. National Phase Application under 35 U.S.C. 371 of International Application No. PCT/US2016/024152 filed on Mar. 25, 2016. The entire disclosure of the above application is incorporated herein by reference.

FIELD

The present disclosure relates to a pill dispenser, such as a pill dispenser insert for a pill container.

BACKGROUND

This section provides background information related to the present disclosure, which is not necessarily prior art.

Although current pill containers and dispensers are suitable for their intended use, they are subject to improvement. For example, a pill dispenser that controls the speed at which pills are dispensed out of a pill container would be desirable. A pill dispenser that orients pills into a predetermined orientation that best arranges the pills to be counted with a mechanical or electronic counter as they are dispensed or loaded would also be desirable. The present teachings advantageously provide for a pill dispenser exhibiting these advantages, as well as numerous others.

SUMMARY

This section provides a general summary of the disclosure, and is not a comprehensive disclosure of its full scope or all of its features.

The present teachings provide for a pill dispenser. The pill dispenser includes a first primary ramp, and a second primary ramp that is opposite to the first primary ramp. Also included is a first secondary ramp, and a second secondary ramp that is opposite to the first secondary ramp. The first and second secondary ramps are both between the first and the second primary ramps. The pill dispenser also has an outlet including outlet sidewalls and an aperture through which pills are dispensed from, or loaded into, the pill dispenser. The outlet sidewalls extend to the aperture from the first primary ramp, the second primary ramp, the first secondary ramp, and the second secondary ramp.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations. The drawings are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
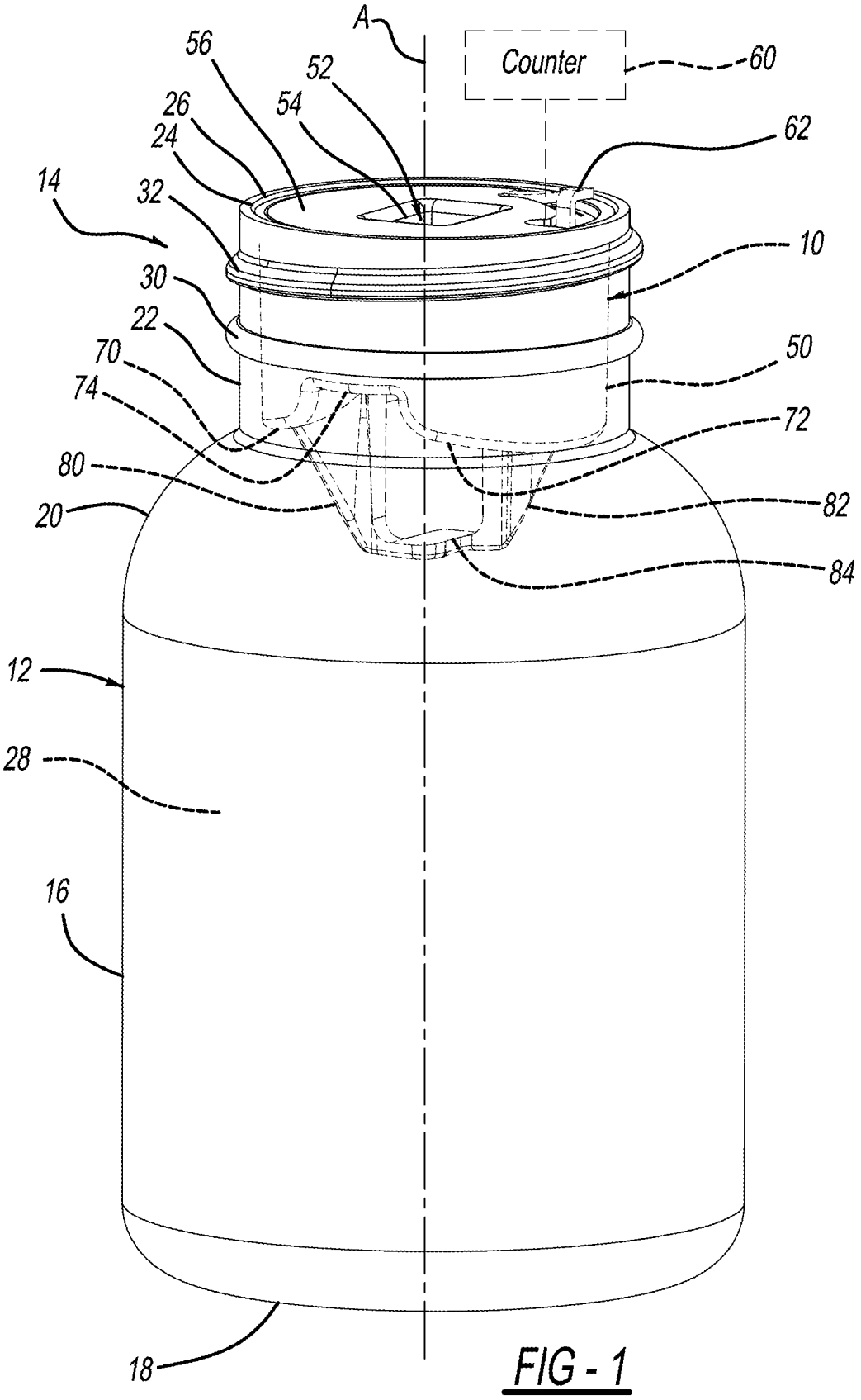
FIG. 1 is a side view of a pill container including a pill dispenser according to the present teachings.
Figure 2:
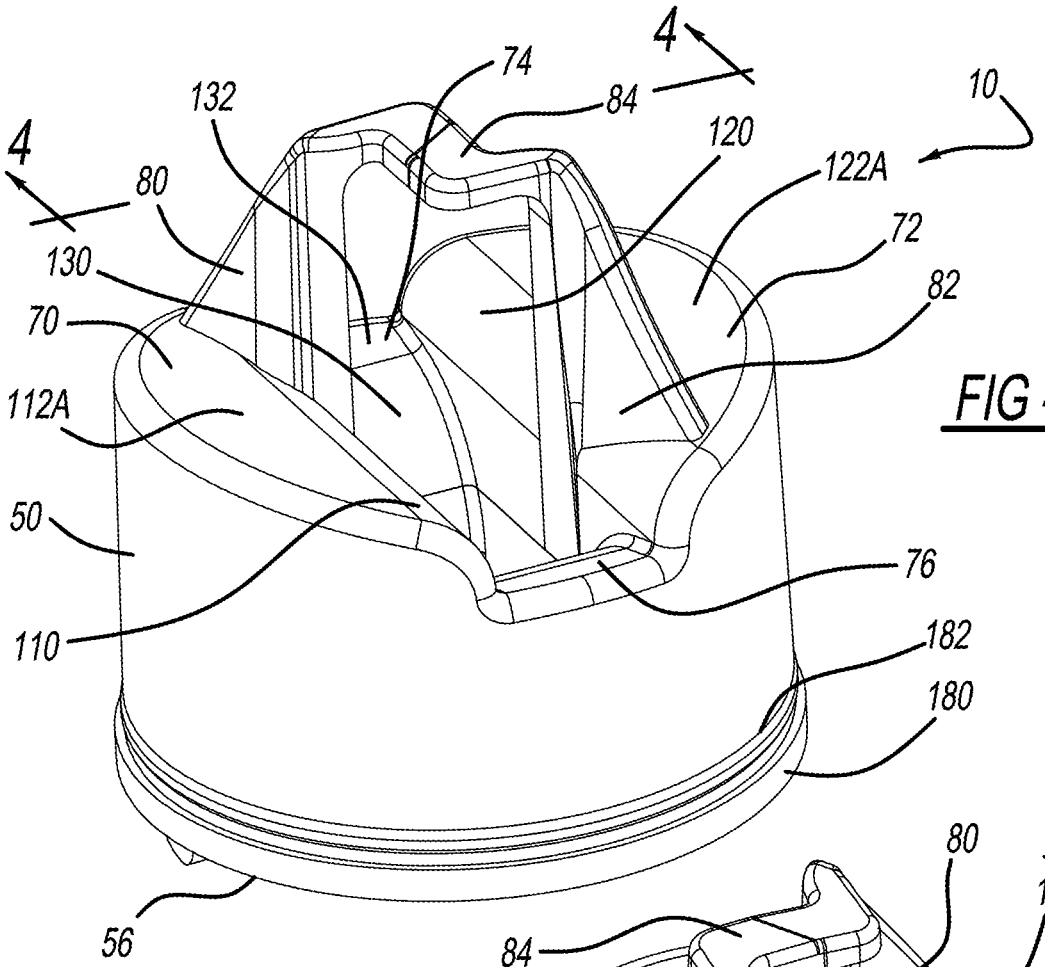
FIG. 2 is a perspective view of the pill dispenser of FIG. 1.
Figure 3:
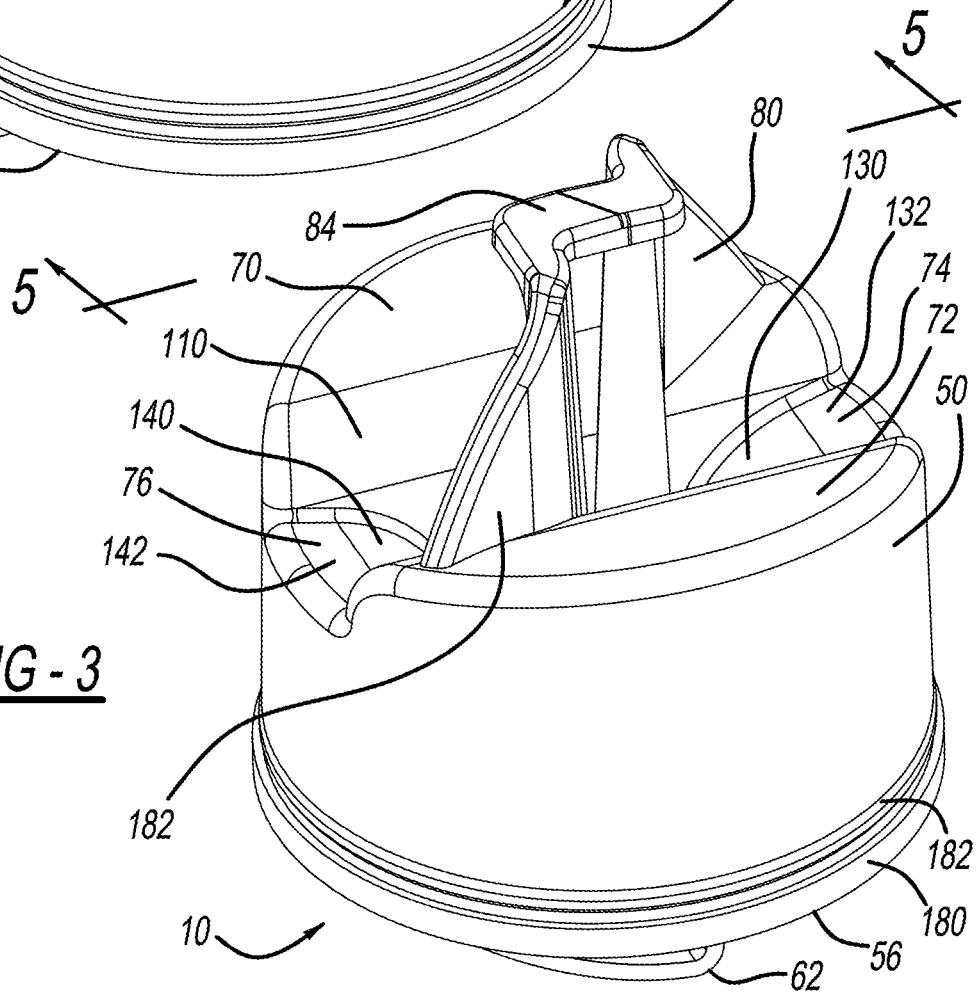
FIG. 3 is another perspective view of the pill dispenser of FIG. 1.

FIG. 1 illustrates a pill dispenser 10 in accordance with the present teachings. The pill dispenser 10 is illustrated as an insert seated within an exemplary container 12 to provide a pill container assembly 14. Thus in the example illustrated the pill dispenser 10 is formed independent of the container 12, and is coupled to the container 12 in any suitable manner, such as press fit, snap fit, adhesive bonding, ultra-sonic welding, spin, or spin welding. Although the pill dispenser 10 is described herein as being configured to dispense or receive a pill, such as medication, the pill dispenser 10, and the assembly 14 generally, can be configured to store and dispense any other suitable object, including food, candy, chemicals, hardware, and the like. And although the pill dispenser 10 is referred to, and primarily described as, a "dispenser" for pills, pills can be loaded into the container 12 through the pill dispenser 10.

The pill dispenser 10 and the container 12 can be made of any suitable material. For example, the pill dispenser 10 and/or the container 12 can be made of any suitable polymeric material, including but not limited to the following: PET, LDPE, HDPE, PP, PS, and the like. The container 12 can be formed using any suitable blow-molding process, for example. The container 12 may also be a glass container.

Features of the container 12 will now be described in detail. The container 12 generally includes a body 16, which is between a standing surface 18 and a shoulder 20. The shoulder 20 tapers inward towards longitudinal axis A of the container 12 as the shoulder 20 extends from the body 16 to a finish 22. The finish 22 extends from the shoulder 20 to a top sealing surface 24, which generally defines an opening 26 of the container 12. The top sealing surface 24 is generally at a first end of the container 12, and the standing surface 18 is generally at a second end of the container 12, which is opposite to the first end. The container 12 defines an internal volume 28 for storing any suitable material, such as medication in the form of a plurality of pills, for example. Extending from an outer surface of the finish 22 is a rib 30, and one or more threads 32. The threads 32 are configured to cooperate with threads of any suitable closure to hold the closure against the top sealing surface 24, in order to seal the container 12 closed.

The pill dispenser 10 generally includes a main body 50. The main body 50 includes a pill outlet 52 (see FIGS. 1, 4, and 5, for example), which defines a pill dispenser aperture 54, through which pills can be dispensed from, or loaded into, the container 12. The dispenser aperture 54 is defined at an outer surface 56 of the dispenser 10. The outer surface 56 is recessed beneath the top sealing surface 24 to allow the closure to contact the top sealing surface 24 and seal therewith. The pill outlet 52 is generally centered at the outer surface 56 such that the longitudinal axis A generally extends through a center of the pill outlet 52. The longitudinal axis A generally extends through an axial center of the container 12 and the pill dispenser 10.

The pill dispenser 10 can include, or be connected to, any suitable counter 60 configured to count the number of pills dispensed from, and/or loaded into, the container 12 as the pills pass through the pill dispenser 10. The counter 60 can be any suitable mechanical or electrical counter configured in any suitable manner. For example, when the counter 60 is an electronic counter, one or more sensors, such as light sensors, can be arranged within the pill outlet 52. When two sensors are provided, the sensors may be aligned vertically with one another, and offset from a center of the pill outlet 52. The counter 60 can further include a counter arm 62. When the closure is coupled to the finish 22, the closure will depress the counter arm 62, thereby deactivating the counter 60. When the closure is removed from the finish 22, the counter arm 62 is biased to move to the raised position (illustrated in FIG. 1), which will activate the counter 60.

With continued reference to FIG. 1, and additional reference to FIGS. 2-6, the pill dispenser 10 includes a plurality of ramps 70, 72, 74, and 76, which are configured to, for example, direct pills within the container 12 to the pill outlet 52, and arrange the pills in any suitable predetermined orientation to facilitate counting of the pills by the counter. The ramps 70, 72, 74, and 76 also provide pill flow control to slow the rate that pills flow out of the container 12 through the pill dispenser 10. This advantageously helps users control how many pills will be dispensed from the container 12, so as to lessen the possibility of dispensing more than the desired dosage.

Figure 8:
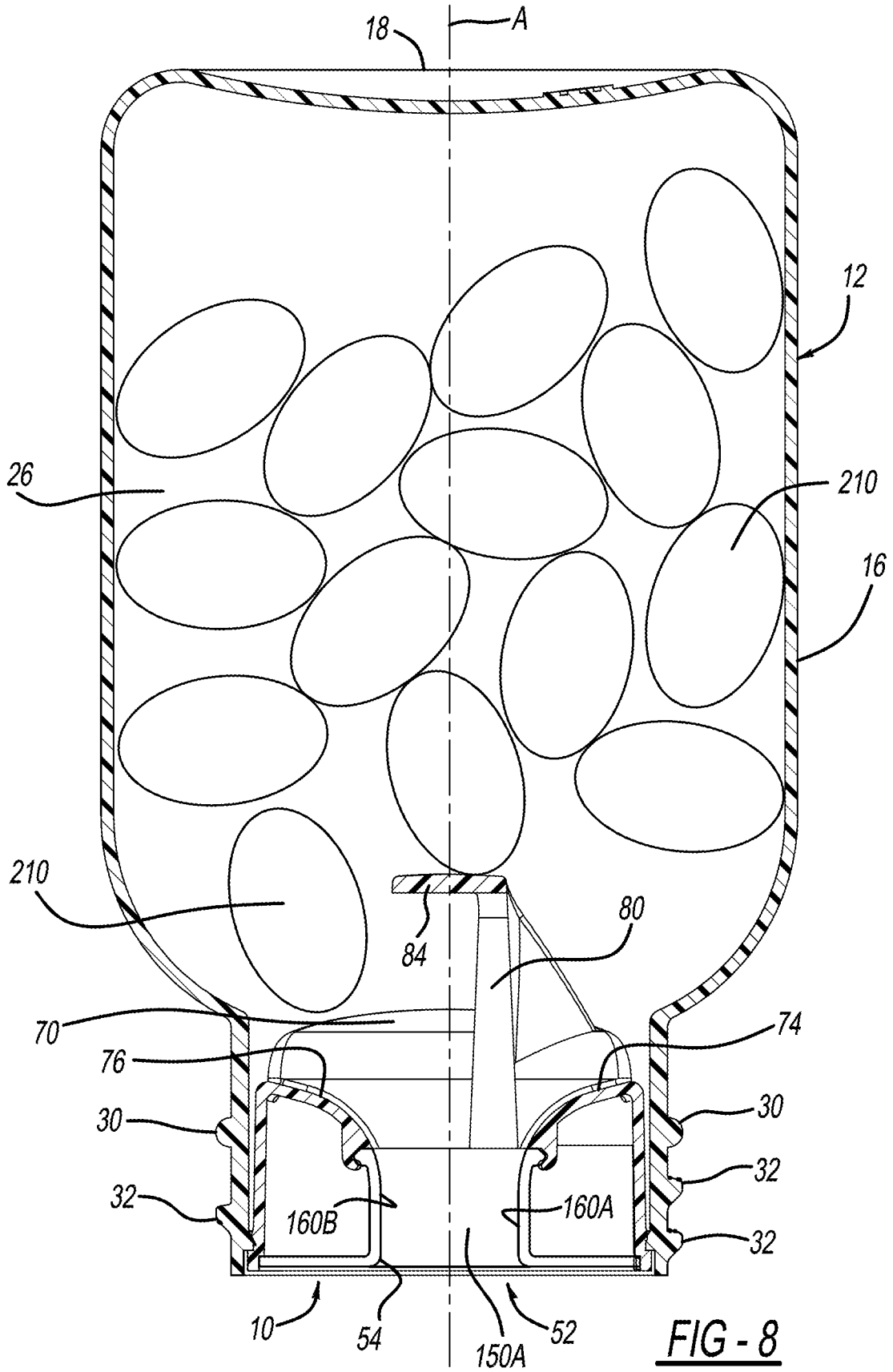
FIG. 8 is a cross-sectional view of the pill container and pill dispenser of FIG. 1 inverted in order to dispense one or more of the exemplary pills of FIGS. 7A and 7B out from within the pill container.

The pill dispenser 10 specifically includes the following ramps: a first primary ramp 70; a second primary ramp 72; a first secondary ramp 74; and a second secondary ramp 76. The first primary ramp 70 is opposite to, and generally faces, the second primary ramp 72. The first secondary ramp 74 is opposite to, and generally faces, the second secondary ramp 76. The first and second secondary ramps 74 and 76 are generally recessed beneath the first and second primary ramps 70 and 72 in the direction of the flow of pills out from within the container 12. Therefore, and as described in detail herein, pills being dispensed from the container 12 (when the container 12 is rotated 90° from the orientation of FIG. 1, as is illustrated in FIG. 8) will first contact the first or second primary ramps 70 or 72, and then slide into contact with the first or second secondary ramps 74 or 76. The ramps 70, 72, 74, and 76 will be described in further detail herein.

The pill dispenser 10 also includes a first guidepost 80 and a second guidepost 82. The first guidepost 80 generally extends from the first primary ramp 70, and the second guidepost 82 generally extends from the second primary ramp 72. The first and second guideposts 80 and 82 support a spacer 84. The spacer 84 is generally supported above the pill outlet 52 and generally aligned along longitudinal axis A, as illustrated in FIG. 1, for example.

The spacer 84 provides a number of advantages. For example, the spacer is able to space a mass of pills, such as pills 210 illustrated in FIG. 8 for example, above the pill dispenser 10 when the container 12 is inverted to prevent the pills 210 from clogging the dispenser 10. The spacer 84 acts as a separator in that it allows pills 210 to separate and fall from the mass of pills 210 to the pill dispenser 10. The spacer 84 also acts as a gate, sorter, limiter, or restrictor in that the spacer 84 limits the flow of pills through the dispenser 10, as is described further herein.

Figure 4:
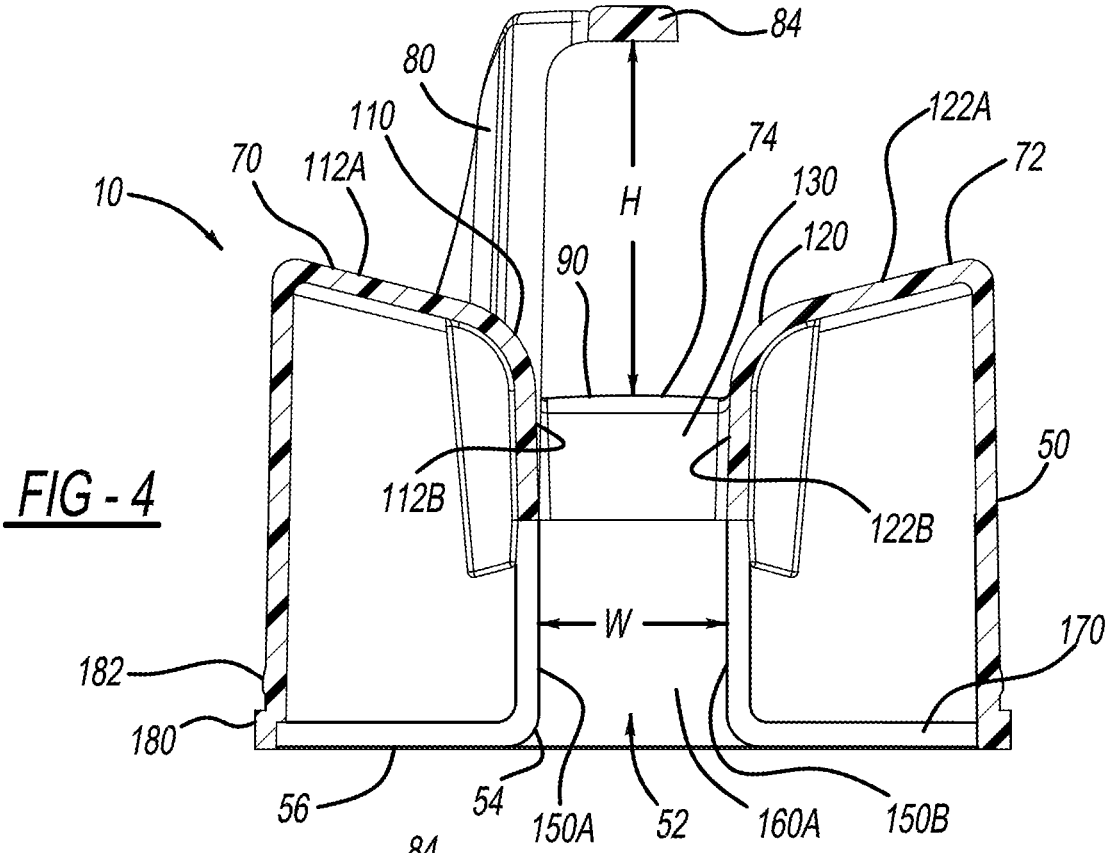
FIG. 4 is a cross-sectional view taken along line 4-4 of FIG. 2.
Figure 5:
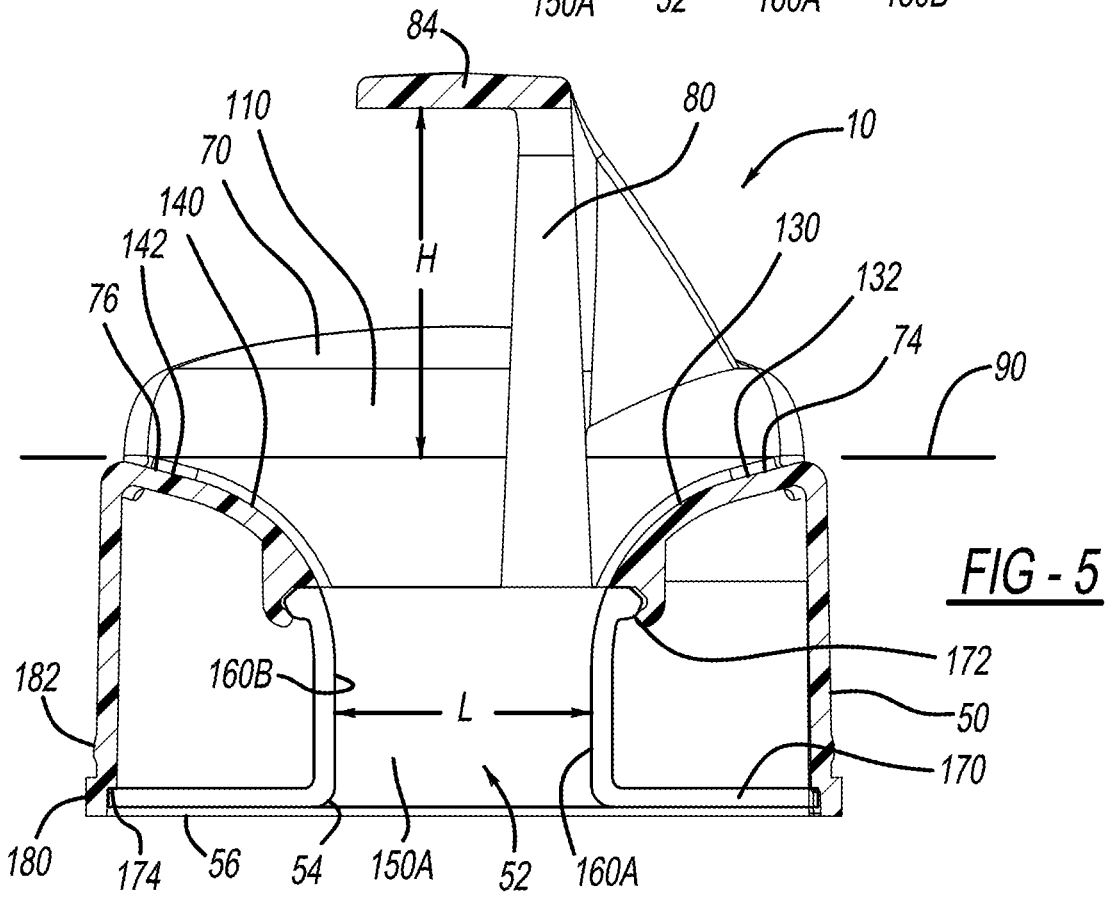
FIG. 5 is a cross-sectional view taken along line 5-5 of FIG. 3.

With exemplary reference to FIGS. 4 and 5, the spacer 84 can be supported by the first and second guideposts 80 and 82 at any suitable height, such as any suitable height H above a plane 90 extending across portions of the first and second secondary ramps 74 and 76 that are furthest from the dispenser aperture 54. The height H can be any height suitable for controlling pill flow through the outlet 52 at a desired rate. For example, the height H can be set to be less than a length L of the pill 210, and greater than each of a width W and depth D of the pill 210 (FIGS. 7A and 7B, for example, illustrate the length L, width W, and depth D of an exemplary pill 210). When set to such a height H, the spacer 84 will advantageously slow the flow of pills 210 through the dispenser 10, which will typically make it easier for a user to dispense a desired number of pills out from within the container 12. Reducing the height H will generally further slow the flow of pills through the dispenser 10. Increasing the height H may also reduce the flow of pills through the dispenser 10. Thus, the height H can be modified based on the dimensions of the pill to be dispensed from the dispenser 10 so that pills are dispensed from the pill dispenser at a desired rate.

Figure 6:
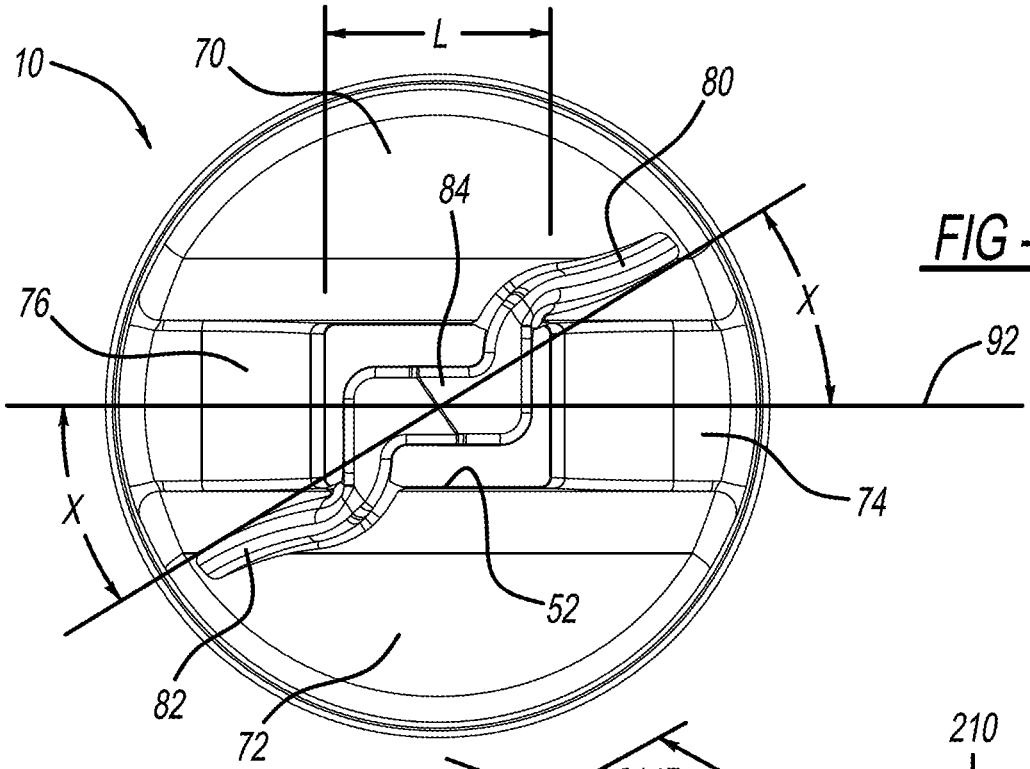
FIG. 6 is a top plan view of the pill dispenser according to the present teachings.

The first and second guideposts 80 and 82 are arranged at any suitable angle to direct pills from the first and second primary ramps 70 and 72 towards the first and second secondary ramps 74 and 76 respectively. Specifically, and as illustrated in FIG. 6, the first guidepost 80 is arranged to direct pills from the first primary ramp 70 to the second secondary ramp 76. The second guidepost 82 is arranged to direct pills from the second primary ramp 72 to the first secondary ramp 74. The first and second guideposts 80 and 82 can be arranged at any suitable angle X relative to line 92 of FIG. 6. For example, angle X can be between 35° and 45°, or about 40°. Line 92 generally extends parallel to a length L of the pill outlet 52 and the aperture 54 thereof, and across a center of each of the pill outlet 52, the first secondary ramp 74, and the second secondary ramp 76, with respect to the orientation of FIG. 6. One skilled in the art will recognize that use of the terms first and second herein is in most cases arbitrary. For example, the second secondary ramp 76 may be referred to as a first secondary ramp, and the first secondary ramp 74 may be referred to as a second secondary ramp.

Specific features of the ramps 70, 72, 74, and 76 will now be described. As illustrated in FIG. 4, for example, the first primary ramp 70 includes a first primary ramp fillet 110, which is between a first generally planar portion 112A and a second generally planar portion 112B. The first and second primary ramps 70 and 72 each have a surface area that is larger than a surface area of the first and second secondary ramps 74 and 76 respectively. The first generally planar portion 112A extends to the first primary ramp fillet 110, and the second generally planar portion 112B extends from the fillet 110 to the outlet 52. The second primary ramp 72 includes a fillet 120, which is between a first generally planar portion 122A and a second generally planar portion 122B. The first generally planar portion 122A extends to the fillet 120, and the second generally planar portion 122B extends from the fillet 120 to the pill outlet 52. The first and the second generally planar portions 112A and 122A are angled towards the fillets 110 and 120 respectively at any suitable angle, such as about 14.5°. The fillet 110 and the fillet 120 are generally opposite to, and face one another. The first and second fillets 110 and 120 can have any suitable curve radius sufficient to direct pills from the first and second primary ramps 70 and 72 to the first and second secondary ramps 74 and 76. For example, the first and second fillets 110 and 120 can each have a curve radius of about 4 mm.

With reference to FIG. 5, for example, the first secondary ramp 74 includes a first secondary ramp fillet 130 and a flat surface or portion 132. The flat surface 132 generally extends from an outer edge of the first secondary ramp 74 to the first secondary ramp fillet 130, which extends to the pill outlet 52. The second secondary ramp 76 includes a second secondary ramp fillet 140 and a generally flat surface 142. The flat surface 142 extends from an outer edge of the second secondary ramp 76 to the second secondary ramp fillet 140, which extends to the pill outlet 52. The flat surfaces 142 and 132 are generally shorter than the planar portions 112A and 122A, and can be angled towards the fillets 130 and 140 at any suitable angle, such as about 15°. The fillets 130 and 140 are generally opposite to, and thus face one another. The first and second secondary ramp fillets 130 and 140 can have any suitable curve radius, such as about 8 mm. In general, the curve radius of the first and second secondary ramp fillets 130 and 140 is greater than the curve radius of the fillets 110 and 120.

With reference to FIGS. 4 and 5, for example, the pill outlet 52 includes first outlet sidewalls 150A and 150B, which are generally linear and define a length L of the pill outlet 52. The first outlet sidewalls 150A and 150B extend from the planar portions 112B and 122B of the first and second primary ramps 70 and 72 respectively. The pill outlet 52 further includes second outlet sidewalls 160A and 160B, which are generally planar and define a width W of the outlet 52. The second outlet sidewalls 160A and 160B extend to the aperture 54 from the fillets 130 and 140 of the first and second secondary ramps 74 and 76 respectively. The pill outlet 52 can be provided with any suitable width W and length L configured to permit passage of pills of any suitable size in a desired orientation, such as an orientation that facilitates counting of the pills by the counter 60. The pill outlet 52 can also be provided with any suitable width W and length L configured to permit passage of pills having any suitable size at a desired speed, such as a speed to control dispensing one at a time. Furthermore, the pill outlet 52 can be round (see dispenser 10A of FIGS. 12A-12C), square (see dispenser 10B of FIGS. 13A-13C), or rectangular (see dispenser 10 of FIGS. 1-6 and 8-11) to permit passage of pills defined by one, two, or three dimensions.

Figure 10:
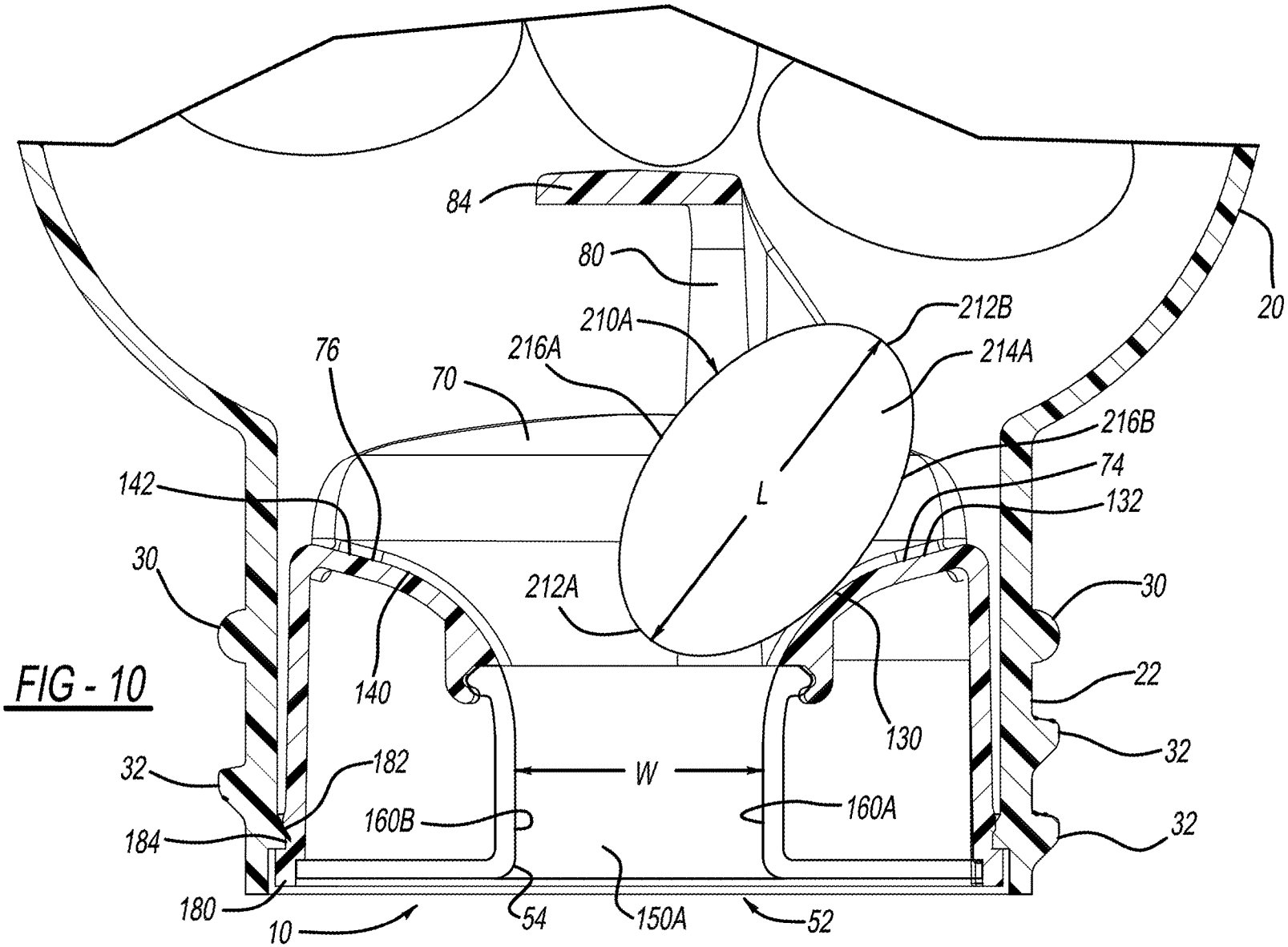
FIG. 10 is a cross-sectional view of a finish portion of the pill container and the pill dispenser of FIG. 1 illustrating the exemplary pill of FIGS. 7A and 7B moving along a secondary ramp of the pill dispenser towards an outlet of the pill dispenser.
Figure 11:
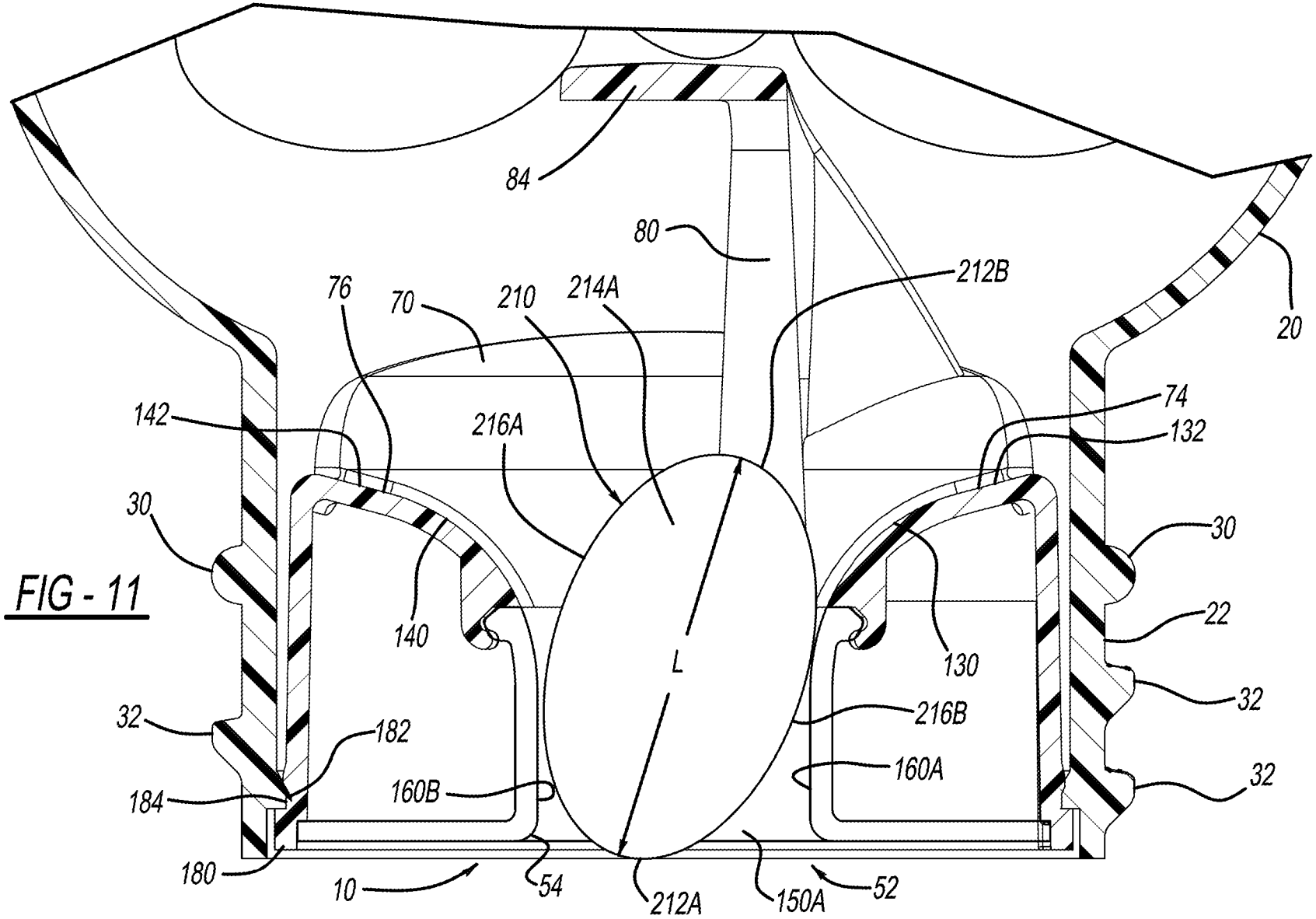
FIG. 11 is a cross-sectional view similar to FIG. 10, but showing the exemplary pill of FIGS. 7A and 7B having slid down the secondary ramp to the outlet just prior to the pill being dispensed.
Figure 12A:
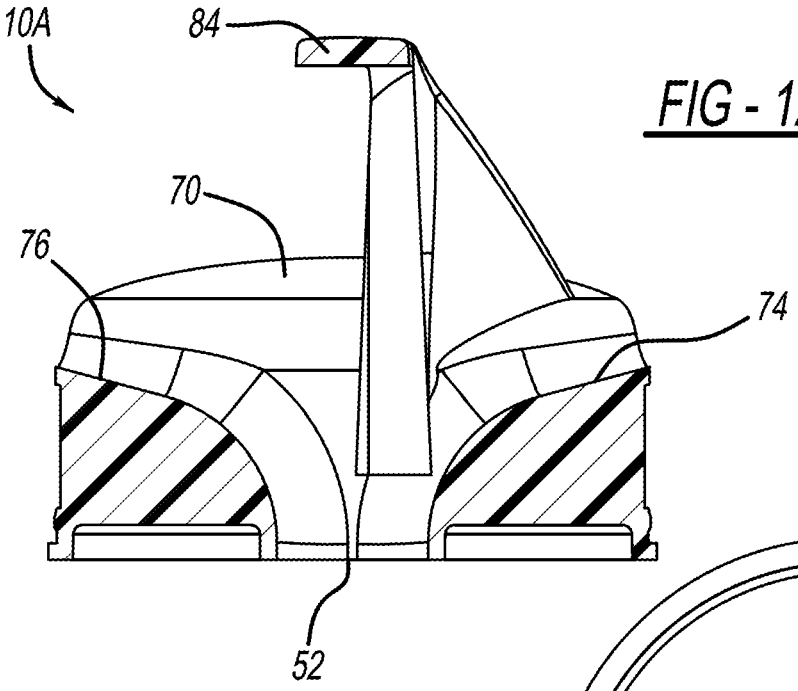
FIG. 12A is a cross-sectional view of an additional pill dispenser according to the present teachings.
Figure 12B:
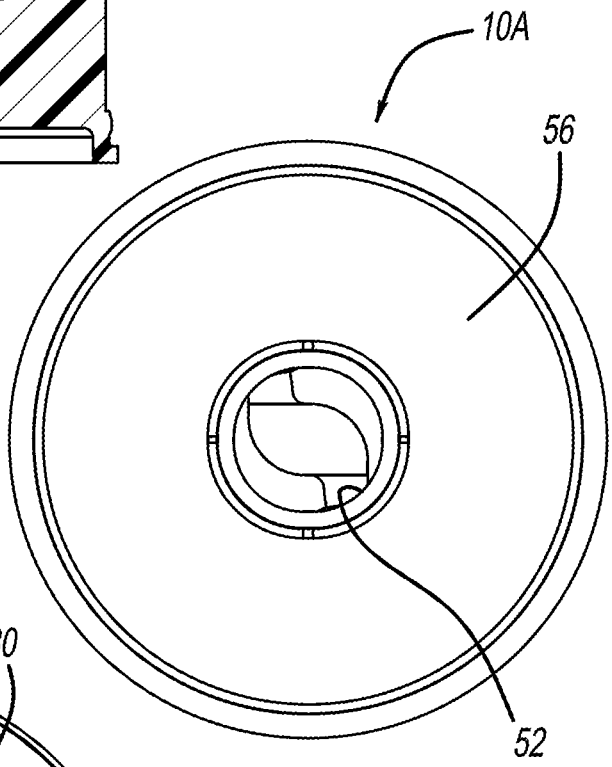
FIG. 12B is a plan view of the pill dispenser of FIG. 12A.
Figure 12C:
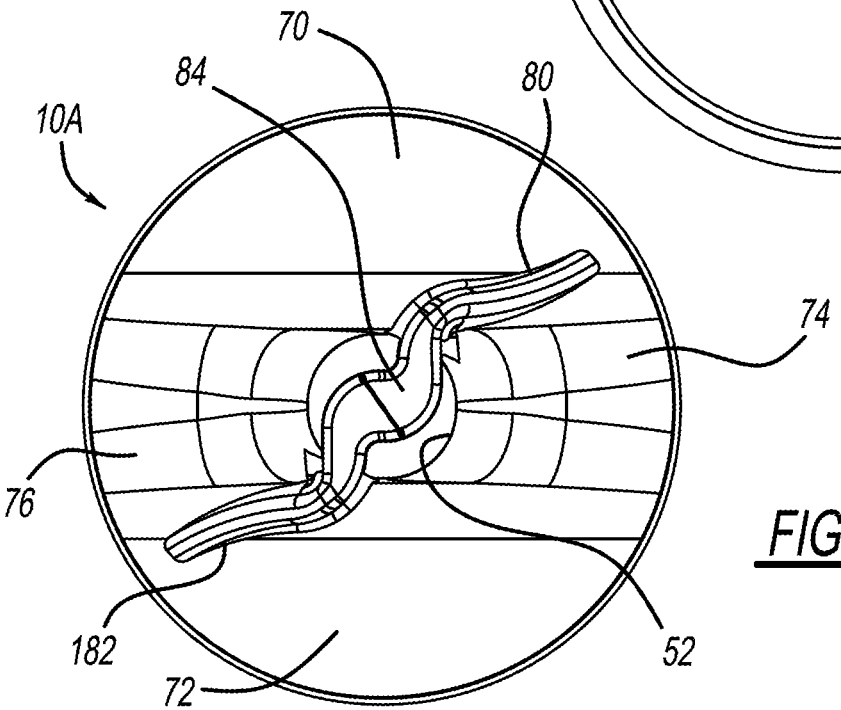
FIG. 12C is another plan view of the pill dispenser of FIG. 12A.
Figure 13A:
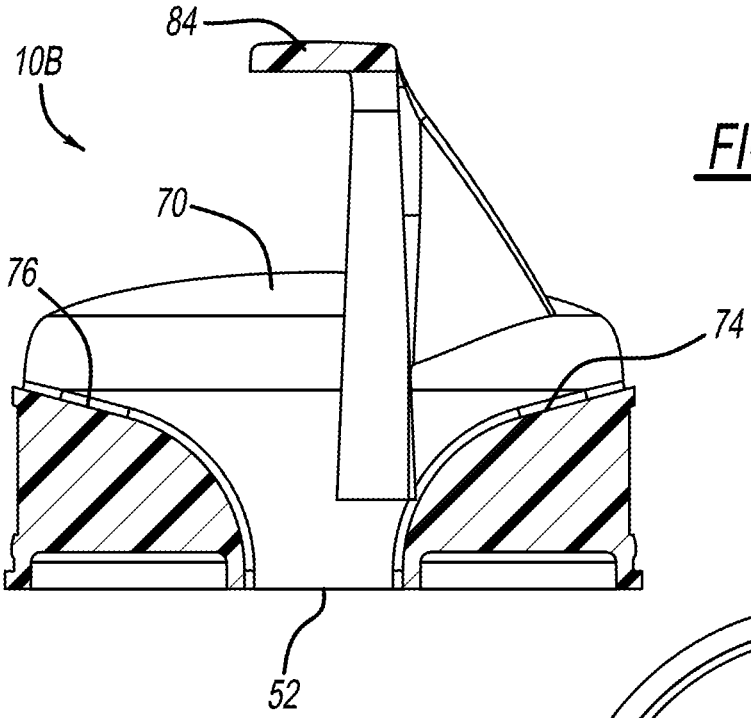
FIG. 13A is a cross-sectional view of another pill dispenser according to the present teachings.
Figure 13B:
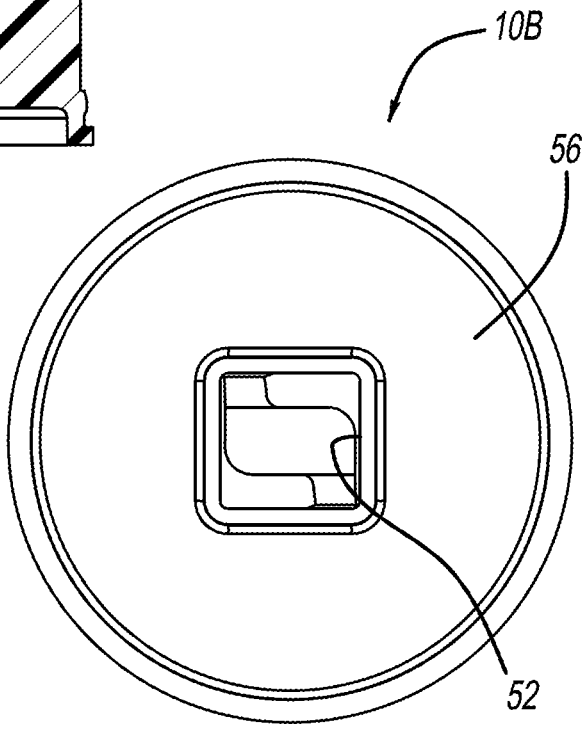
FIG. 13B is a plan view of the pill dispenser of FIG. 13A.
Figure 13C:
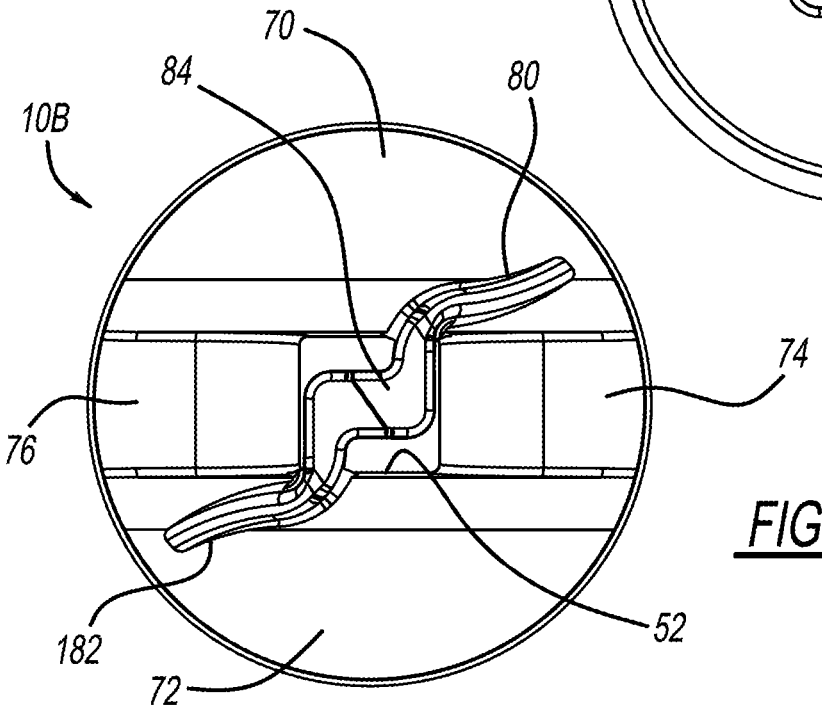
FIG. 13C is another plan view of the pill dispenser of FIG. 13A.

The pill dispenser 10 can be constructed from at least one piece as shown in FIGS. 12A and 13A, or can be a multiple piece assembly as shown in FIG. 5. For example, the pill outlet 52 can be integral with the rest of the pill dispenser 10, or may be a modular component coupled to the rest of the pill dispenser 10 in any suitable manner. For example, the pill outlet 52 can include an outlet defining member 170, which is coupled to the rest of the pill dispenser 10 with any suitable coupling configuration 172 (see FIG. 5). The outlet defining member 170 can include the outer surface 56, which defines the aperture 54, and can include the sidewalls 150A, 150B, 160A, and 160B. A ledge 174 can be configured to support the outlet defining member 170. To support the pill dispenser 10 within the finish 22, an outer surface of the main body 50 can include a dispenser flange 180 and a tab 182. The dispenser flange 180 and the tab 182 are configured to receive a finish support flange 184 protruding from an interior of the finish 22 (see FIGS. 10 and 11) in order to support the pill dispenser 10 within the finish 22 as illustrated in FIGS. 1, 8, 10, and 11. Alternatively, the pill outlet 52 can be integral with the rest of the pill dispenser to provide one-piece pill dispenser 10A of FIGS. 12A-12C, or one-piece pill dispenser 12B of FIGS. 13A-13C. The pill dispensers 10A and 10B can thus be monolithic. The pill outlet 52 can have any suitable shape. For example, the pill outlet 52 of dispenser 10A can be round as illustrated in FIGS. 12A-12C. Alternatively, the pill outlet 52 of dispenser 10B can be square as illustrated in FIGS. 13A-13C.

Figure 7A:
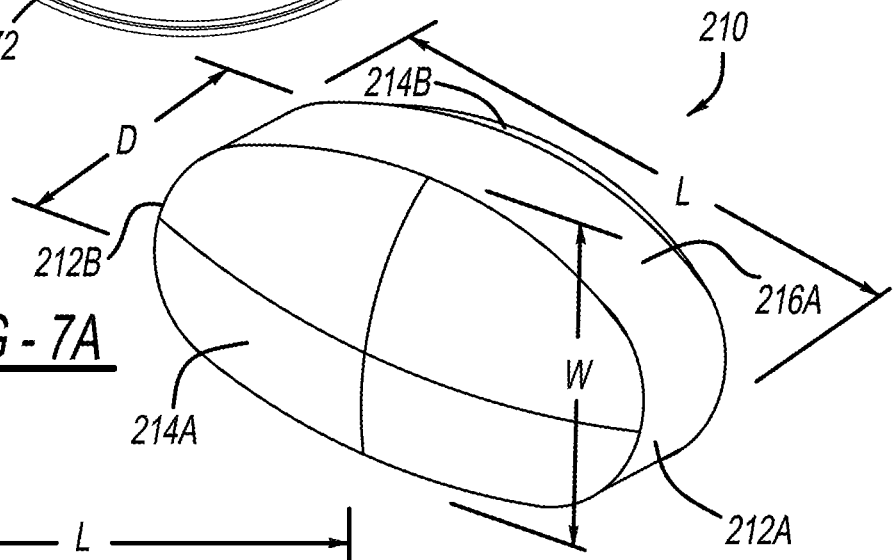
FIG. 7A is a perspective view of an exemplary pill that the pill dispenser of FIG. 1 is configured to dispense.
Figure 7B:
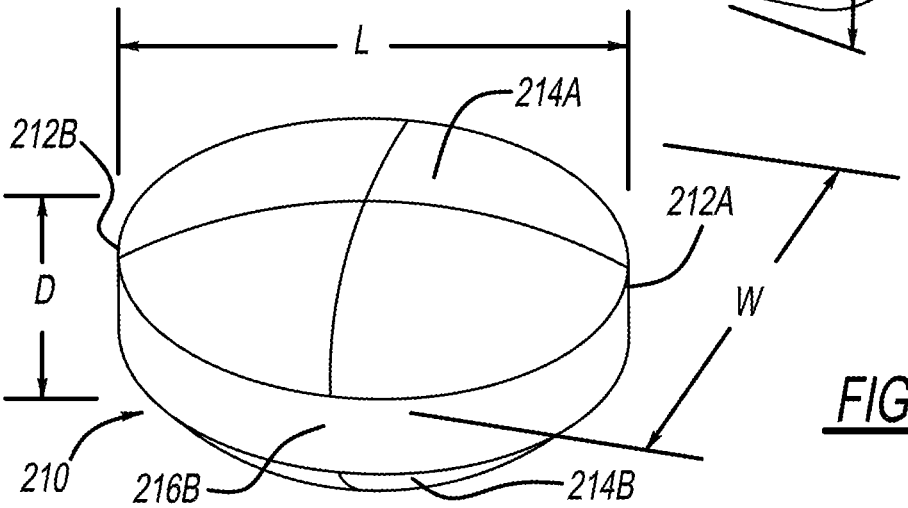
FIG. 7B is another perspective view of the exemplary pill of FIG. 7A.

The pill dispenser 10 can be configured to dispense and receive pills of any suitable size and shape. FIGS. 7A and 7B illustrate an exemplary pill at reference numeral 210. The pill 210 includes a first nose end 212A and a second nose end 212B. A first main body surface 214A is opposite to a second main body surface 214B. Extending between the first and second main body surfaces 214A and 214B are first and second side surfaces 216A and 216B. The pill 210 has a maximum length L as measured from the nose end 212A to the nose end 212B. A maximum width W of the pill 210 is defined between the first side surface 216A and the second side surface 216B at portions thereof that are furthest from each other. The pill 210 defines a maximum depth D measured between the first main body surface 214A and the second main body surface 214B, at portions thereof that are furthest from each other. The first and second main body surfaces 214A and 214B generally bow outward along the lengths L and widths W thereof. Thus the pill 210 generally varies in size and shape in three dimensions, but could also be defined by any two dimensions, such as a tablet or capsule, or by only a single dimension, such as a sphere. The pill dispenser 10 can be configured to accommodate pills of any shape or size. For example, the dispenser 10 can be configured to accommodate pills that vary in only two dimensions, such as pills with round first and second main body surfaces and a round side surface, as opposed to the generally oval main body surfaces 214A and 214B, and the generally semi-oval side surfaces 216A and 216B, of the pill 210.

With reference to FIGS. 8-11, operation of the pill dispenser 10 to dispense pills out of the container 12 will now be described. FIG. 8 illustrates the container 12 with a plurality of pills 210 stored therein. The container 12 has been inverted from the storage position of FIG. 1 in order to dispense one or more pills 210 out from within the container 12. The container 12 is generally inverted such that the longitudinal axis A is generally perpendicular to the surface that the pills 210 are to be dispensed to, such as a user's hand. When the pill dispenser 10 is inverted to the dispensing orientation of FIG. 8, a space or gap is defined between the pills 210 furthest from the pill dispenser 10 and the standing surface 18, as is illustrated in FIG. 8. The space or gap is present even in a full pill container 12, because the container 12 is typically never completely filled with pills 210 in order to prevent clogging of the dispenser 10 with pills 210, and to generally facilitate dispensing of pills 210. To dispense one or more of the pills 210, such as pill 210A, the container 12 may be gently shaken to cause pill 210A, or any other pill 210, to move towards the pill dispenser 10. At the same time, the spacer 84 prevents too many other pills 210 from moving towards the pill dispenser 10, or slows the movement of pills 120, which advantageously prevents the dispenser 10 from being clogged.

Figure 9:
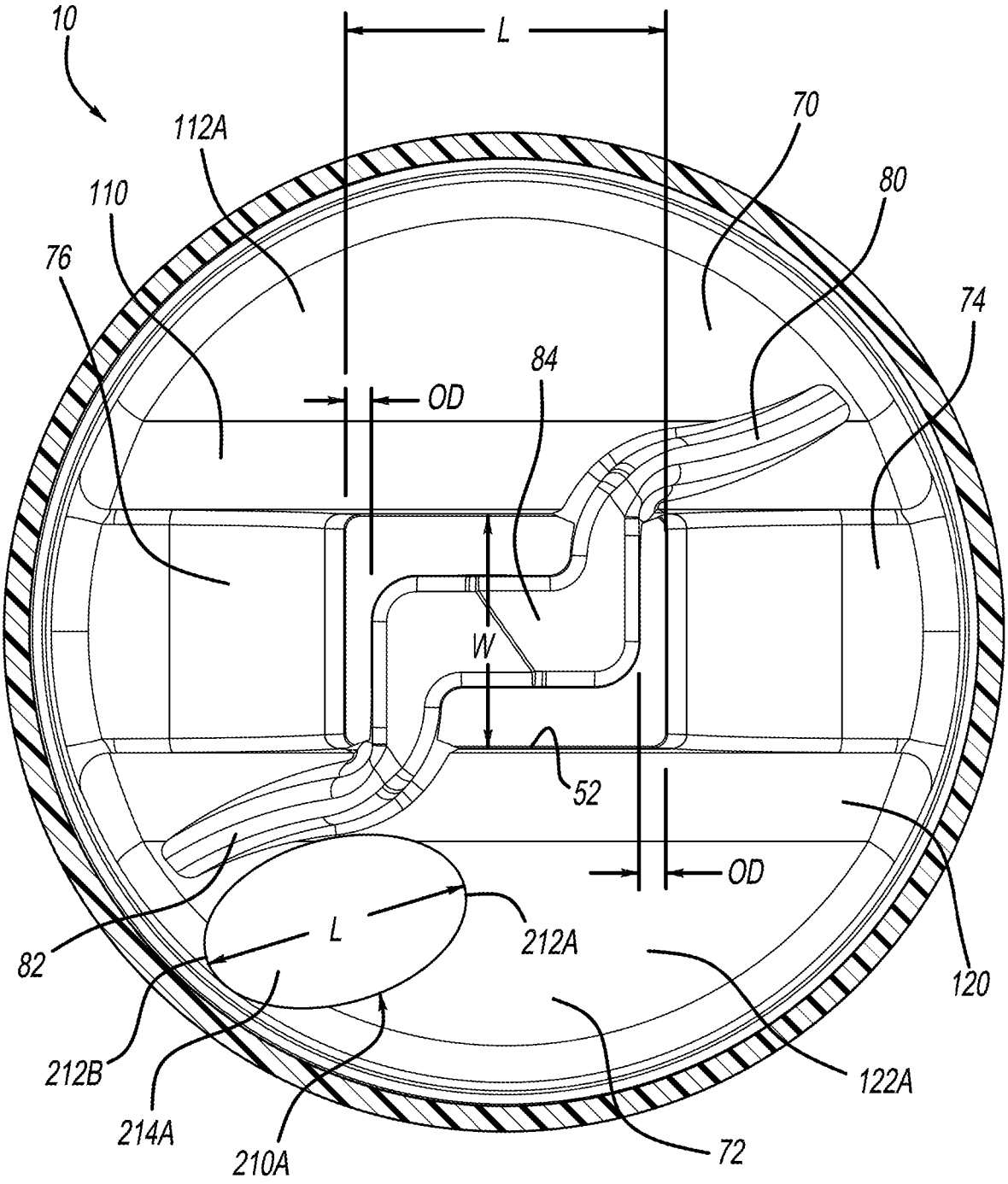
FIG. 9 is a top plan view of the pill dispenser of FIG. 1 illustrating one of the exemplary pills of FIGS. 7A and 7B seated on a primary ramp of the pill dispenser and aligned lengthwise along a guidepost in accordance with the present teachings.

As illustrated in FIG. 9, once the pill 210A reaches the dispenser 10, the pill 210A will typically contact the first or second primary ramps 70 or 72, and the first or second guideposts 80 or 82 thereof, to orient the pill 210A lengthwise along the first or second guideposts 80 or 82 with the pill 210 sitting on the first or second main body surfaces 214A or 214B. In the example of FIG. 9, the pill 210A initially contacts the second primary ramp 72 and the second guidepost 82, but the pill 210A could just as easily contact the first primary ramp 70 and the first guidepost 80.

With respect to the exemplary illustration of FIG. 9, upon contacting the second guidepost 82, the second guidepost 82 will orient the pill 210A such that the length L of the pill 210A extends generally parallel to the second guidepost 82, which will cause the pill 210A to slide lengthwise down the second primary ramp 72 nose first. In other words, and as illustrated in FIG. 9, the nose end 212A will be arranged at a point furthest down the second primary ramp 72. The pill 210A will slide down the planar portion 122A and then to the second primary fillet 120 of the second primary ramp 72. As the pill 210A slides over the second primary fillet 120, the nose end 212A will dip downward towards the first secondary ramp 74, and typically contact the first secondary ramp 74 as the pill 210A moves to the first secondary ramp 74. Had the pill 210A initially contacted the first guidepost 80, the pill 210A would have moved from the first primary ramp 70 to the second secondary ramp 76 in a similar manner. The first guidepost 80 and the second guidepost 82 are shifted from corners of the outlet 52 away from the first and second secondary ramps 74 and 76 respectively by offset distance OD, as illustrated in FIG. 9, in order to facilitate transfer of pills 210 from the first and second primary ramps 70 and 72 to the first and second secondary ramps 74 and 76.

The first secondary ramp 74 has a width W, which is slightly larger than the depth D of the pill 210, but smaller than the length L and the width W of the pill 210, so as to accommodate the pill 210 on the first secondary ramp 74 in only a single orientation (the second secondary ramp 76 has the same width W). Specifically and as illustrated in FIG. 10, the pill 210A will be arranged along the first secondary ramp 74 such that either the first side surface 216A or the second side surface 216B is in contact with the flat portion 132, thereby orienting the pill 210A so that the depth D of the pill 201A extends across the width W of the ramp 74. As the pill 210A, and specifically first or second side surfaces 216A/216B thereof, slides down the flat portion 132 to the first secondary ramp fillet 130, the pill 210A will begin to rotate and move into the pill outlet 52, as illustrated in FIG. 11. Advantageously, the width W and length L of the pill outlet 52 and the aperture 54 thereof position the pill 210A in the outlet 52 such that either of the nose ends 212A/212B will exit the outlet 52 first. The pill 210A will move to the outlet 52 from the second secondary ramp 76 in a similar manner.

Thus the first and second guideposts 80 and 82 advantageously align the pill 210A lengthwise along either the first or second primary ramps 70/72. The first and second secondary ramps 74/76 advantageously align the pill 210A such that the depth dimension D of the pill 210A extends across either the first or second secondary ramps 74/76, and the first or second side surfaces 216A/216B are seated on the ramp 74/76. In this manner, the ramps 70, 72, 74, and 76 place the pill 210A in a predetermined orientation when passing into and through the pill outlet 52. This predetermined orientation may be best suitable for counting the pills 210, such as with a mechanical or electronic counter.

All of the dimensions and angles described herein of the pill dispenser 10 can be modified as necessary in order to accommodate pills of various different sizes, and to control the rate that particular pills are dispensed from the container 12 through the pill dispenser 10.

The pill dispenser 10 advantageously acts as a pill limiter. Therefore, if for example the container 12 falls over so that it is no longer supported on the standing surface 18, the pills 210 will not freely fall out from within the container 12. Instead, none or only a small number of the pills 210 will pass through the pill dispenser 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A pill dispenser comprising:

a first primary ramp, and a second primary ramp opposite to the first primary ramp;

a first secondary ramp, and a second secondary ramp opposite to the first secondary ramp, wherein the first and second secondary ramps are both between the first and the second primary ramps; and an outlet including outlet sidewalls and an aperture through which pills are dispensed from or loaded into the pill dispenser, the outlet sidewalls extend to the aperture from the first primary ramp, the second primary ramp, the first secondary ramp, and the second secondary ramp;

wherein the pill dispenser is an insert configured to be secured within a finish of a pill bottle; and wherein the pill dispenser is configured to be secured within the finish below a top sealing surface of the finish.

2. The pill dispenser of claim 1, wherein the first and second primary ramps are each further from the aperture than the first and the second secondary ramps.

3. The pill dispenser of claim 1, wherein the outlet is centered along a longitudinal axis of the pill dispenser and pill bottle that the pill dispenser is coupled to.

4. The pill dispenser of claim 1, wherein each one of the first and second primary ramps has a first surface area that is greater than a second surface area of either one of the first and second secondary ramps.

5. The pill dispenser of claim 1, wherein the outlet sidewalls include;

a first pair of outlet sidewalls defining a length of the outlet and the aperture; and a second pair of outlet sidewalls defining a width of the outlet and the aperture;

wherein the length is greater than the width;

wherein the outlet is sized and shaped such that a pill having rounded nose ends at opposite ends of a longitudinal axis can only pass through the outlet nose end first; and wherein the pill includes a length that is greater than a width, which is greater than a depth.

6. The pill dispenser of claim 1, wherein the outlet sidewalls are planar.

7. The pill dispenser of claim 1, wherein the pill dispenser includes a pill counter configured to count how many pills are dispensed from, and loaded into, a pill bottle associated with the pill dispenser.

8. The pill dispenser of claim 1, further comprising:

a first guidepost extending from the first primary ramp;

a second guidepost extending from the second primary ramp; and a spacer supported by the first guidepost and the second guidepost.

9. The pill dispenser of claim 8, wherein:

the first guidepost is angled to direct pills from the first primary ramp to the first secondary ramp; and the second guidepost is angled to direct pills from the second primary ramp to the second secondary ramp.

10. The pill dispenser of claim 8, wherein the spacer is supported over a plane extending across portions of the first and second secondary ramps that are furthest from the outlet, the spacer supported at a distance from the plane that is less than a length of a pill that the pill dispenser is configured to dispense, and greater than both a width and depth of the pill.

11. The pill dispenser of claim 8, wherein the first guidepost and the second guidepost extend towards sidewalls of the outlet defining a length of the outlet, and extend to a point offset from sidewalls of the outlet defining a width of the outlet.

12. The pill dispenser of claim 9, wherein the first guidepost and the second guidepost are each arranged at an angle of about 35 to 45 from a longitudinal axis extending parallel to a length of the outlet.

13. The pill dispenser of claim 1, wherein:

the first primary ramp includes a first primary ramp fillet;

the second primary ramp includes a second primary ramp fillet;

the first secondary ramp includes a first secondary ramp fillet; and the second secondary ramp includes a second secondary ramp fillet.

14. The pill dispenser of claim 13, wherein the first primary ramp fillet and the second primary ramp fillet are each configured to direct pills to the first and second secondary ramps.

15. The pill dispenser of claim 13, wherein;

the first primary ramp fillet and the second primary ramp fillet each have a curve radius of about 4 mm; and the first secondary ramp fillet and the second secondary ramp fillet each have a curve radius of about 8 mm.

16. The pill dispenser of claim 1, wherein each one of the first and second secondary ramps has a width that greater than a depth of a pill that the pill dispenser is configured to dispense, and less than both a length and a width of the pill, such that the pill can only move along the first and the second secondary ramps in a single predetermined orientation.

17. The pill dispenser of claim 16, wherein in the single predetermined orientation the pill is oriented such that a nose end of the pill passes through the aperture first when the pill is being dispensed.

18. The pill dispenser of claim 13, wherein:

the first primary ramp fillet is between two planar portions of the first primary ramp;

the second primary ramp fillet is between two planar portions of the second primary ramp;

the first secondary ramp fillet is between two planar portions of the first secondary ramp; and the second secondary ramp fillet is between two planar portions of the second secondary ramp.

19. A pill dispenser comprising:

an outlet;

a first primary ramp and a second primary ramp opposite to the first primary ramp;

a first secondary ramp and a second secondary ramp opposite to the first secondary ramp, the first and the second secondary ramps are closer to the outlet than the first and second primary ramps;

a first guide post adjacent to the first primary ramp;

a second guide post adjacent to the second primary ramp; and a spacer supported by the first guide post and the second guide post;

wherein:

the first guide post is configured to align lengthwise pills sliding down the first primary ramp, and to direct pills to the first secondary ramp;

the second guide post is configured to align lengthwise pills sliding down the second primary ramp, and to direct pills to the second secondary ramp; and the first and second secondary ramps both direct pills to the outlet, and are configured to align pills such that a depth of the pills extends across widths of the first or second secondary ramps.

20. The pill dispenser of claim 19, wherein the outlet is sized and shaped such that pills having rounded nose ends can only pass through the outlet nose end first.

21. The pill dispenser of claim 19, wherein the first and second primary ramps each have a primary surface area that is greater than a secondary surface area of each one of the first and second secondary ramps.

22. The pill dispenser of claim 19, wherein the pill dispenser is configured to be secured within a finish of a bottle below a top sealing surface of the finish.

23. The pill dispenser of claim 19, wherein the pill dispenser includes a pill counter configured to count how many pills pass through the pill dispenser.

24. The pill dispenser of claim 19, wherein the first guidepost and the second guidepost are each arranged at an angle of about 35 to 45 from a longitudinal axis extending parallel to a length of the outlet.

25. The pill dispenser of claim 19, wherein the spacer is supported over a plane extending across portions of the first and second secondary ramps that are furthest from the outlet, the spacer supported at a distance from the plane that is less than a length of a pill that the pill dispenser is configured to dispense, and greater than both a width and depth of the pill.

26. The pill dispenser of claim 19, further comprising four planar outlet sidewalls, each one of the four planar outlet sidewalls extends from one of the following:

the first primary ramp;

the second primary ramp;

the first secondary ramp; and the second secondary ramp.

27. The pill dispenser of claim 26, wherein each one of the four planar outlet sidewalls defines an outlet aperture of the pill dispenser, the outlet aperture has a length greater than a width.

28. The pill dispenser of claim 19, wherein:

the first primary ramp includes a first primary ramp fillet between two planar portions of the first primary ramp;

the second primary ramp includes a second primary ramp fillet between two planar portions of the second primary ramp;

the first secondary ramp includes a first secondary ramp fillet between two planar portions of the first secondary ramp; and the second secondary ramp includes a second secondary ramp fillet between two planar portions of the second secondary ramp.

29. The pill dispenser of claim 28, wherein:

the first and the second primary ramp fillets have a curve radius of about 4 mm; and the first and the second secondary ramp fillets have a curve radius of about 8 mm.

30. A pill dispenser for a pill having maximum length, width, and depth dimensions that are each different, and nose ends at opposite ends of the length dimension, the depth dimension extends perpendicular to the length and width dimensions, the pill dispenser comprising:

an outlet;

a first primary ramp including a first primary ramp fillet;

a second primary ramp including a second primary ramp fillet;

a first secondary ramp including a first secondary ramp fillet;

a second secondary ramp including a second secondary ramp fillet;

a first guide post adjacent to the first primary ramp;

a second guide post adjacent to the second primary ramp;

a spacer supported by the first guide post and the second guide post;

wherein:

the first guide post is configured to align the length dimension of the pill along the first guide post, and orient the pill so that the pill slides down the first primary ramp nose end first, and over the first primary ramp fillet to the first secondary ramp;

the second guide post is configured to align the length dimension of the pill along the second guide post, and orient the pill so that the pill slides down the second primary ramp nose end first, and over the second primary ramp fillet to the second secondary ramp;

the first and second secondary ramps each have a ramp width that is greater than the depth dimension of the pill and smaller than both the width and length dimensions of the pill so as to align the pill with the depth dimension thereof extending across the ramp width, and align the length dimension of the pill along a length of the first and second secondary ramps; and the first and second secondary ramps each orient the pill so that the pill slides to the outlet nose end first.

31. The pill dispenser of claim 30, wherein the pill dispenser includes a pill counter.

32. The pill dispenser of claim 30, wherein the first guidepost and the second guidepost are each arranged at an angle of about 35° to 45° from a longitudinal axis extending parallel to a length of the outlet.

33. The pill dispenser of claim 30, wherein the spacer is supported over a plane extending across portions of the first and second secondary ramps that are furthest from the outlet, the spacer supported at a distance from the plane that is less than the maximum length dimension of the pill, and greater than the maximum width and maximum depth dimensions of the pill.

34. The pill dispenser of claim 30, wherein:

the first primary ramp fillet and the second primary ramp fillet each have a curve radius of about 4 mm; and the first secondary ramp fillet and the second secondary ramp fillet each have a curve radius of about 8 mm.

35. The pill dispenser of claim 30, wherein the first and second primary ramps are each further from the aperture than the first and the second secondary ramps.

36. The pill dispenser of claim 30, wherein each one of the first and second primary ramps has a first surface area that is greater than a second surface area of either one of the first and second secondary ramps.

37. The pill dispenser of claim 30, wherein:

the first primary ramp fillet is between two planar portions of the first primary ramp;

the second primary ramp fillet is between two planar portions of the second primary ramp;

the first secondary ramp fillet is between two planar portions of the first secondary ramp; and the second secondary ramp fillet is between two planar portions of the second secondary ramp.

38. The pill dispenser of claim 30, further comprising four planar outlet sidewalls, each one of the four planar outlet sidewalls extends from one of the following:

the first primary ramp;

the second primary ramp;

the first secondary ramp; and the second secondary ramp.

39. A pill dispenser comprising:

a first primary ramp, and a second primary ramp opposite to the first primary ramp;

a first secondary ramp, and a second secondary ramp opposite to the first secondary ramp, wherein the first and second secondary ramps are both between the first and the second primary ramps;

an outlet including outlet sidewalls and an aperture through which pills are dispensed from or loaded into the pill dispenser, the outlet sidewalls extend to the aperture from the first primary ramp, the second primary ramp, the first secondary ramp, and the second secondary ramp;

a first guidepost extending from the first primary ramp;

a second guidepost extending from the second primary ramp; and a spacer supported by the first guidepost and the second guidepost.

40. A pill dispenser comprising:

a first primary ramp, and a second primary ramp opposite to the first primary ramp;

a first secondary ramp, and a second secondary ramp opposite to the first secondary ramp, wherein the first and second secondary ramps are both between the first and the second primary ramps; and an outlet including outlet sidewalls and an aperture through which pills are dispensed from or loaded into the pill dispenser, the outlet sidewalls extend to the aperture from the first primary ramp, the second primary ramp, the first secondary ramp, and the second secondary ramp;

wherein;

the first primary ramp includes a first primary ramp fillet;

the second primary ramp includes a second primary ramp fillet;

the first secondary ramp includes a first secondary ramp fillet; and the second secondary ramp includes a second secondary ramp fillet.

41. A pill dispenser comprising:

a first primary ramp, and a second primary ramp opposite to the first primary ramp;

a first secondary ramp, and a second secondary ramp opposite to the first secondary ramp, wherein the first and second secondary ramps are both between the first and the second primary ramps; and an outlet including outlet sidewalls and an aperture through which pills are dispensed from or loaded into the pill dispenser, the outlet sidewalls extend to the aperture from the first primary ramp, the second primary ramp, the first secondary ramp, and the second secondary ramp;

wherein:

the outlet sidewalls include a first pair of outlet sidewalls defining a length of the outlet and the aperture, and a second pair of outlet sidewalls defining a width of the outlet and the aperture;

the length is greater than the width;

the outlet is sized and shaped such that a pill having rounded nose ends at opposite ends of a longitudinal axis can only pass through the outlet nose end first; and the pill includes a length that is greater than a width, which is greater than a depth.

42. A pill dispenser comprising:

a first primary ramp, and a second primary ramp opposite to the first primary ramp;

a first secondary ramp, and a second secondary ramp opposite to the first secondary ramp, wherein the first and second secondary ramps are both between the first and the second primary ramps; and an outlet including outlet sidewalls and an aperture through which pills are dispensed from or loaded into the pill dispenser, the outlet sidewalls extend to the aperture from the first primary ramp, the second primary ramp, the first secondary ramp, and the second secondary ramp;

wherein each one of the first and second secondary ramps has a width that greater than a depth of a pill that the pill dispenser is configured to dispense, and less than both a length and a width of the pill, such that the pill can only move along the first and the second secondary ramps in a single predetermined orientation.

* * * * *